United States Patent [19]

Klygis

[11] Patent Number: 4,691,860

[45] Date of Patent: Sep. 8, 1987

[54] FOLDABLE CONTAINER CARRIER COLLAPSIBLE CONTAINER CARRIER WITH CRUCIFORM HANDLE

[75] Inventor: Mindaugas J. Klygis, Barrington, Ill.

[73] Assignee: Illinois Tool Works Inc., Chicago, Ill.

[21] Appl. No.: 941,229

[22] Filed: Dec. 15, 1986

[51] Int. Cl.[4] ..... B65D 5/46

[52] U.S. Cl. ..... 229/52 A; 206/427; 220/94 R; 229/41 R; 229/49

[58] Field of Search ..... 229/49, 52 A, 52 AM,47, 229/41 R, 41 B, 914, DIG. 6; 206/427, 435; 220/94 R; 217/125; 16/110.5, 113, 114 R, DIG. 12, DIG. 15, DIG. 19; D9/434, 443; D8/321

[56] References Cited

U.S. PATENT DOCUMENTS

| | | | |
|---|---|---|---|
| 810,574 | 1/1906 | Sewell | 229/52 A |
| 1,757,814 | 5/1930 | Quiggin et al. | 206/427 |
| 2,071,663 | 2/1937 | Smith | 229/47 |
| 2,114,737 | 4/1938 | Gray | 220/94 R |
| 2,503,544 | 4/1950 | Clore | 206/435 |
| 2,767,855 | 10/1956 | Brown | 229/52 A |
| 2,974,779 | 3/1961 | Belsinger | 229/49 |
| 3,194,461 | 7/1965 | Tupper | 220/94 R |
| 3,352,451 | 11/1967 | Struble | 229/52 A |

*Primary Examiner*—Stephen Marcus
*Assistant Examiner*—Gary E. Elkins
*Attorney, Agent, or Firm*—Thomas W. Buckman

[57] ABSTRACT

A simple two-piece carrier is disclosed for accommodating at least four containers having two rows to two containers each. The main part of the carrier is a foldable blank having coining lines which define four foldable sidewall panels. The second part of the carrier is a generally cruciform shaped handle member which slidingly cooperates with the four sidewall panels to provide pockets for each container. The carrier also includes a locking feature which maintains the carrier in a flat folded condition prior to use.

7 Claims, 7 Drawing Figures

FOLDABLE CONTAINER CARRIER COLLAPSIBLE CONTAINER CARRIER WITH CRUCIFORM HANDLE

BACKGROUND OF THE INVENTION

The present invention relates to container carriers, and more particularly to a foldable container carrier for a predetermined number of beverage cans, bottles or cups.

Carriers are well known and have been used in various forms for enabling a user to transport a predetermined number of containers in a relatively easy fashion. Some of these carriers are used by bottlers for arranging bottles or cans in a compact carrier for the handling convenience of a consumer. Other carriers are used in restaurants, especially fast food restaurants, for arranging cups having lids for transportation to a remote area for consumption. These carriers must also minimize spilling of the beverage within the cup containers.

The majority of carriers described above are made of paper or cardboard and employ various foldable designs. These designs are desirable since the carriers are easy to transport and store in a flat condition prior to its use and are unfolded at the time of purchase to accommodate the beverage cups. Some of these carriers also incorporate handles for easy of carrying.

Another type of carrier employed mainly by restaurants is one which is formed of paper or cardboard into a desired shape. The paper or cardboard in these carriers is relatively thick and stiff for ease of transport. This type of carrier has been found to be quite unstable and difficult to carry, especially when only one container is present in the carrier.

Existing carriers suffer from a number of drawbacks. One of the main drawbacks is the complexity of the carrier itself. This is especially true with the various foldable carriers which are rather intricate and rely on a number of folding members to form sidewalls within the carrier. Other wall members are sometimes necessary to support these sidewalls as well as the containers, and many also employ foldable handles which cooperate with these walls in a confusing network.

Another problem with existing carriers is their lack of attractiveness and inability to provide billboard or advertising space on the carrier itself. This is an important criteria due to the enormous amount of competition in the respective industries and the need for a manufacturer to provide easy product identification to the consumer. Moreover, it provides a medium for advertising without any additional distribution not only for the product contained within the carrier but for other products, games or the like.

The handles used by previous carriers have also been a problem area. As descried earlier, not only are these handles complex, but they do not always hold the carrier properly especially when wet. Additionally, such handles have been found to be too hard to carry for the consumer.

Storage and packing of existing carriers has not always been an attractive feature. Some of the foldable carriers are oddly shaped when flat while the formed papers carriers are too bulky.

Finally, probably one of the most important factors with existing carriers is the cost. Generally, these carriers have been expensive due to their complexity and are normally provided free of charge to the consumer. This cost must obviously be tacked on to the cost of the beverage. It would therefore be advantageous from a competitive standpoint to reduce the cost of such a carrier as much as possible.

The present carrier overcomes the aforementioned problems by providing a simple two-piece carrier for accommodating at least four containers having two rows of two containers each. The main part of the carrier is a foldable blank having coining lines which define four foldable sidewall panels. The second part of the carrier is a generally cruciform shaped handle member which slidingly cooperates with the four sidewall panels to provide pockets for each container. The carrier also includes a locking feature which maintains the carrier in a flat folded condition prior to use.

Such a carrier is easily manufactured by employing two cut out blanks which readily assemble to provide a neat and simple interaction. The present carrier also provides ample billboard space, a sturdy carry means in any environment and is readily foldable into a simple arrangement for storage. All of the above features are provided in a carrier whose material cost is significantly lower than previous carriers.

It is therefore an object of the present invention to provide a unique foldable container carrier for use with a number of predetermined containers.

It is a feature of the present invention to have a container carrier whose handle actively cooperates to form the carrier itself as well as a lock for maintaining the carrier is a flat folded position.

It is an advantage of the present invention that the carrier can provide proper transportation of a plurality of beverage containers at a reduced cost with a simple reliable design.

BRIEF DESCRIPTION OF THE DRAWINGS

The features of the present invention which are believed to be novel are set forth with particularity in the appended claims. The invention, together with further objects and advantages thereof may best be understood by making reference to the following description taken in conjunction with the accompanying drawings in the several figures of which like reference numerals identify identical elements and wherein:

DESCRIPTION OF THE PREFERRED EMBODIMENT

Figure 1:
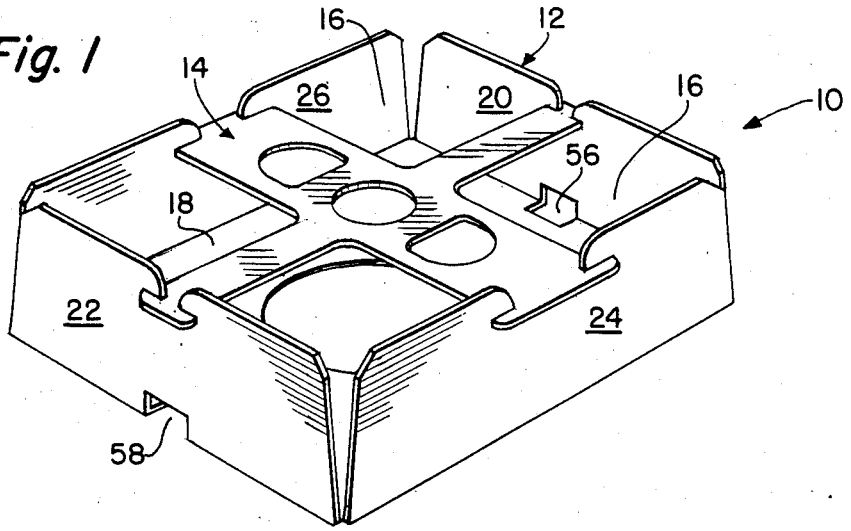
FIG. 1 is a perspective view of a first embodiment of the container carrier of the present invention in its open position.
Figure 2:
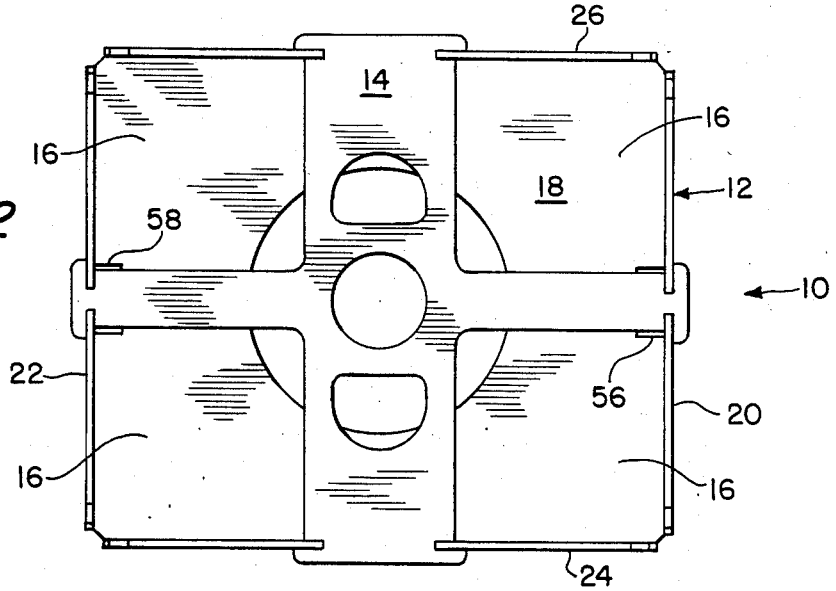
FIG. 2 is a top plan view of the container carrier of FIG. 1.

Referring now to the drawings in greater detail, there is illustrated in FIG. 1 a container carrier 10 constructed according to the teachings of the present invention.

The carrier 10 consists of a foldable blank 12 and a handle member 14 which cooperate to form container receiving portions 16 when the carrier 10 is in its open position as illustrated in FIG. 1.

The blank 12 can be made from any type of material which will permit the necessary folding, and, in the preferred embodiment, is constructed from paper or cardboard.

Figure 4:
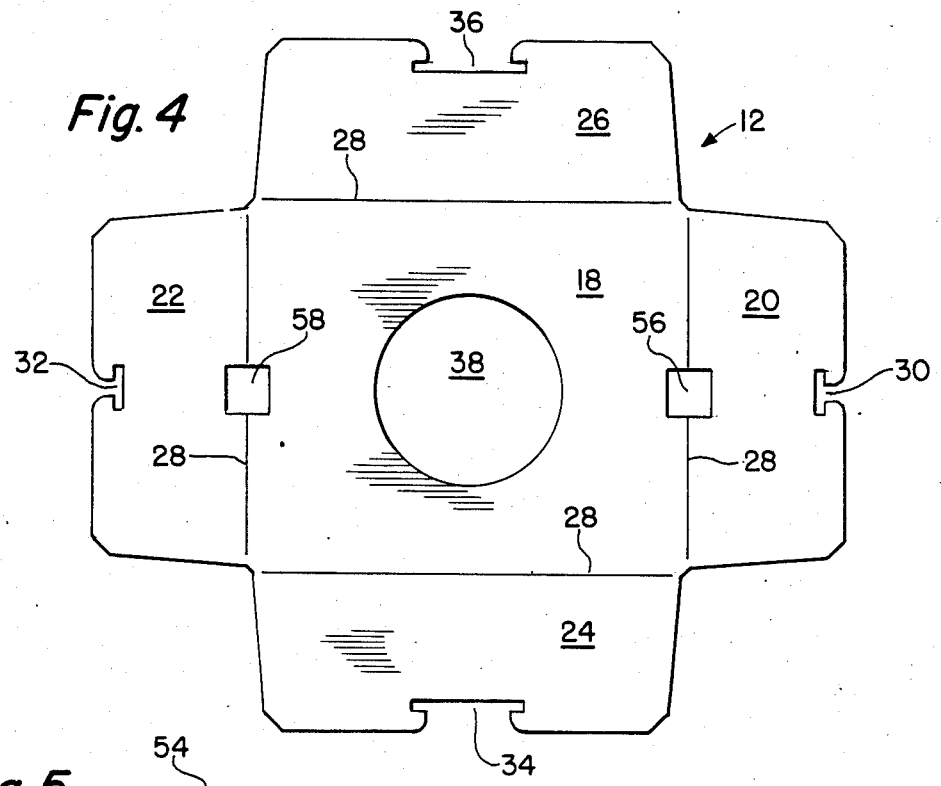
FIG. 4 is a top plan view of the base of the carrier of FIG. 1 in its flat unassembled position.

Referring now to FIGS. 1 and 4, the blank 12 is formed from a flat piece of cardboard to the desired shape. This shape in the preferred embodiment consists of a base member 18 and sidewall members 20, 22, 24 and 26. To enable proper folding of the blank 12, coining lines 28 are struck when the blank 12 is formed in the appropriate places to form a type of hinge at the base of each sidewall 20, 22, 24 and 26. These hinges are common in the art and enable the black 12 to be folded where appropriate to form the desired shape of the carrier 10 without separation of the sidewalls 20, 22, 24 and 26 from the base 18, even after repeated folding.

At the distal end of each sidewall 20, 22, 24 and 26 a slot 30, 32, 34 and 36 is formed respectively. These slots 30, 32, 34 and 36, are opened on the distal end of each sidewall 20, 22, 24 and 26 and cooperate with the handle member 14 in a manner which will be described in detail hereinafter.

The base member 18 may also have a central aperture 38 struck in its center to conserve weight and material cost and also to permit any spilled beverage to flow out of the carrier 10.

Figure 5:
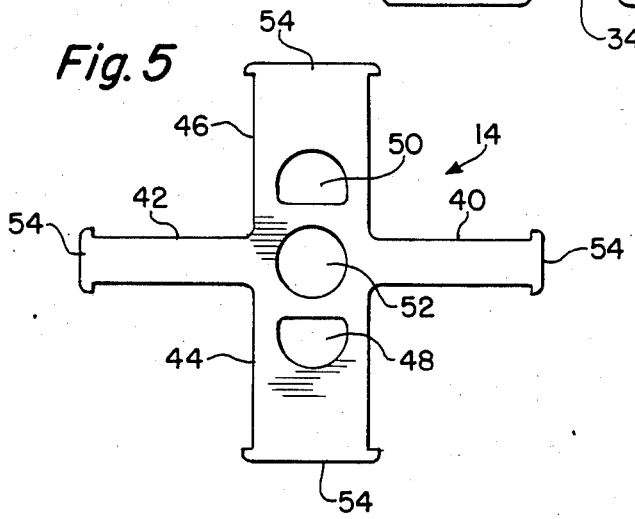
FIG. 5 is a top plan view of the handle member of the carrier of FIG. 1 in its unassembled position.

The handle member 14, as illustrated in FIG. 1 and 5 may be made from any type of material which will properly hold the blank 12 and is made from plastic in the preferred embodiment.

As FIG. 5 illustrates, the handle member 14 is formed from a flat piece of plastic to the desired cruciform shape. The handle 14 consists of four arm members 40, 42, 44 and 46 which form the cruciform described above with arms 40 and 42, being somewhat thinner in width than arms 44 and 46. It is to be noted that the cruciform shape has been incorporated only as a matter of design choice and that any shaped handle member may be employed to accomplish the desired results.

The handle member 14 further incorporates two semi-circular shaped apertures 48 and 50 which are located on arm members 44 and 46 respectively. These apertures 48 and 50 are finger holes for the user to employ to enable transporting the carrier 10 with one hand. Handle member 14 can also be constructed with a central aperture 52 to allow for a reduction of weight as well as material.

Integral with the distal ends of each arm member 40, 42, 44 and 46 is a head portion 54. Each head portion 54 is basicaly identical in shape but may vary with the width of each arm member 40, 42, 44 and 46.

Figure 6:
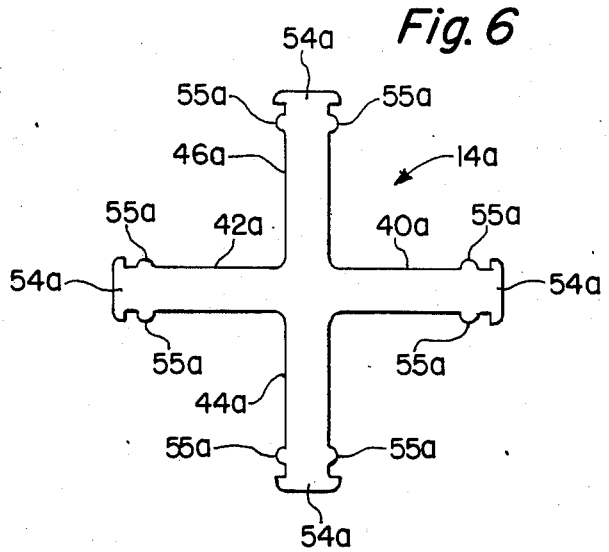
FIG. 6 is a top plan view of a second embodiment of the handle member of FIG. 5 in its unassembled position.

FIG. 6 illustrates a second embodiment of handle member 14 and is denoted by similar reference numerals as the first embodiment with the addition of subscript "a". In this embodiment, the finger holes 48 and 50 have been eliminated as well as the central aperture 52 and all of the arm members **40*a*, 42*a*, 44*a* and 46*a* have approximately the same width. Additionally, each head portion 54*a* is virtually identical due to the similarity of arm members 40*a*, 42*a*, 44*a* and 46*a*. In this embodiment, the user may grasp the handle 14*a* at the proximal end of the arm members to transport the carrier 10 with one hand. In all other respects, the handle 14*a* functions identically to handle 14 of the first embodiment. Alternatively, due to its inherent stability, the carrier 10 may easily be gripped by the base member 18 and either sidewall 20, 22, 24 or 26** with one hand without any deformation.

The handle **14*a* of FIG. 6 can also employ a ridge member 55*a* on each arm member 40*a*, 42*a*, 44*a* and 46*a* near each head portion 54*a*. This ridge 55*a*, enables each sidewall 20, 22, 24 and 26 to maintain a position perpendicular to the base member 18 without folding inwardly until a desired amount of force is exerted. Although this ridge member 55*a* is only shown in the drawings with respect to the second embodiment of handle 14, it is to be noted that these ridge members 55*a*** may be employed to the first embodiment in a similar manner.

Assembly and operation of the carrier 10 will now be explained in greater detail with reference to the first embodiment of the invention. The blank 12 is formed or stamped from a flat sheet of cardboard to the desired flat shape illustrated in FIG. 4. Next, each sidewall 20, 22, 24 and 26 is rotated about its respective coining line 28 to a portion approximately perpendicular to the base member 18. Next, the handle 14 is affixed to blank 12 by inseting the heads 54 of each arm member 40, 42, 44 and 46 into its respective slot 30, 32, 34 and 36. This insertion is accomplished by slightly bending the blank 12 near the open face of each slot 30, 32, 34 and 36 to accommodate the respective arm members 40, 42, 44 and 46. It is to be noted that proper orientation must be maintained in the preferred embodiment between arm member 40, 42, 44 and 46 and sidewalls 20, 22, 24 and 26 due to the difference in width of arm members 40, 42, 44 and 46 as described above.

After the handle 14 has been properly inserted into the slots 30, 32, 34 and 36 of the blank 12, the carrier 10 assumes the shape depicted in FIG. 1 and is in position for use. In this position, beverage containers (not shown) may be inserted into container receiving portions 16 of the carrier 10 for holding. The user may then carry the carrier 10 by gripping the sides or bottom of the carrier 10 or may use the finger holes 48 and 50 to carry the carrier 10 from above with one hand. When this is done, each head portion 54 prevents the handle 14 from pulling out of the slots 20, 22, 24 and 26 while the beverage container prevents the blank 12 from folding inwardly.

Figure 3:
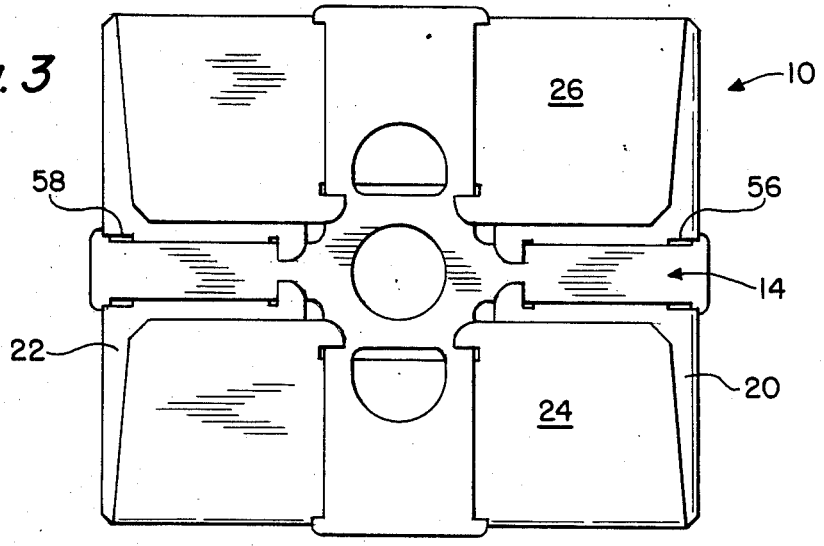
FIG. 3 is a top plan view of the container carrier of FIG. 1 in its closed position.

Before or after transporting, the carrier 10 may be folded to assume the state illustrated in FIG. 3. This state is obtained when no beverage containers are present in the carrier 10 and each sidewall 20, 22, 24 and 26 is folded inwardly toward the base member 18. This is accomplished by the inherent sliding cooperation between each sidewall 20, 22, 24 and 26 and its respective arm member 40, 42, 44 and 46 which arises from the present design. Although FIG. 3 illustrates sidewalls 20 and 24 (corresponding to the arm members 40 and 42) being folded inwardly first, it is to be noted that the sidewalls 20, 22, 24 and 26 may be folded inwardly in any desired combination.

The state of the carrier 10 illustrated in FIG. 3 is the state in which the carrier 10 may be positioned to enable easy storage. This state is relatively flat which enables stacking of the carrier 10 in a minimum amount of space while maintaining a square shape to further aid in shipping and handling.

As illustrated in FIGS. 1 through 4, the carrier 10 may also incorporate locking tabs 56 and 58 to maintain the carrier 10 in its inwardly folded position. As FIG. 4 more properly depicts, the tabs 56 and 58 are actually rectangular or square shaped apertures which are formed at the intersection of sidewalls 20 and 22 and the base 18 and are basically intersected by the coining lines 28 of the respective sidewalls. These locking tabs 56 and 58 are shown only at the proximal ends of sidewalls 20 and 22, but can be at the proximal ends of sidewalls 24 and 26 only or at the proximal end of each sidewall 20, 22, 24 and 26 if desired.

Figure 7:
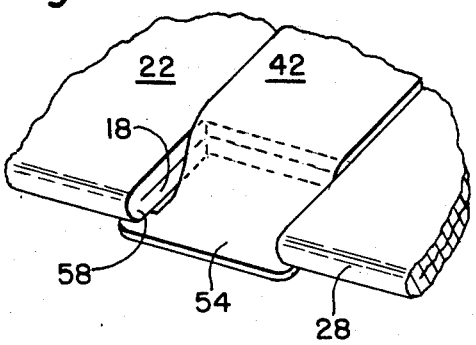
FIG. 7 is a detailed perspective view of the locking feature of the carrier of the present invention.

FIG. 7 more appropriately illustrates the operation of each locking tab 58. When the carrier 10 is folded to its storage state as described above and illustrated in FIG. 3, the head members 54 of the arm member 40 and 42 extends to a position somewhat beyond the reverse edge of the respective coining line 28. With this arrangement, the head portion 54 may then be positioned through the locking tab 58 to the back side of the base 18 to maintain the carrier 10 in its inwardly folded state. Consequently, any bending of the sidewalls 20, 22, 24 or 26 to move upward into an open position is restricted due to the locking tab 58.

In operation, a carrier 10, complete with handle 14 is positioned after manufacture in its flat state as illustrated in FIG. 3. This state is maintained during shipping and storage until its use. After choosing a carrier 10 from storage, the user then unfolds each sidewall 20, 22, 24 and 26 which slides along its respective arm members 40, 42, 44 and 46 through slits 30, 32, 34 and 36 until the unfolded portion illustrated in FIG. 1 is reached. Thereafter, a desired number of beverage containers are inserted into the container receiving portions 16 of the carrier 10 and the user may use finger holes 48 and 50 to enable transportation with one hand.

It is to be noted that the beverage containers should preferably be positioned in the appropriate receiving portions 16 for proper weight stability. Accordingly, it is desirable to use four or two containers (positioned diagonally opposite each other) for proper weight balancing. However, as was mentioned previously, the design of the present carrier 10 is extremely stable even if only one container is present in the carrier 10 due to the interaction of the handle 14 and the sidewalls 20, 22, 24 and 26.

While a particular embodiment of the present invention has been shown and described, modification may be made to the carrier without departing from the teachings of the present invention. Accordingly, the scope of the invention is only to be limited as necessitated by the accompanying claims.

I claim:

1. A two-piece foldable container carrier comprising:

a base member having first and second pairs of opposing sidewall panels which divide said base member into a central base panel between four foldable sidewall panels, each of said sidewall panels having a slot formed in its distal end opposite said central base panel;

a handle member having a generally cruciform shape formed by arm members which extend a distance corresponding to the dimensions of said central base panel for sliding engagement with said slots of said sidewall panels, and retention means integral with distal ends of said arm members for retaining said arm members within said slots whereby said sidewalls are relatively perpendicular to said central base panel when in use and are folded inwardly to a relatively flat position for storage and said retention means is capable of restricting said sidewall panels from folding outwardly when said sidewalls are perpendicular to said central base while being capable of permitting said sidewall panels to fold inwardly to a relatively flat position while slidingly engaging said arm members of said handle member.

2. The container carrier of claim 1, further comprising:

means for retaining said carrier in a folded position when said sidewalls are inwardly folded.

3. The container carrier of claim 2, wherein said means for retaining further comprises:

engagement means at exterior proximal ends of at least two of said sidewalls for engagement with said distal ends of said arm members when said sidewalls are inwardly folded.

4. The container carrier of claim 3, wherein said retention means further comprises:

a head integrally formed with the distal ends of each of said arm members which protrudes through said slots for engagement with the exterior side of each of said sidewalls whereby said sidewalls are restricited from folding outwardly while being capabale of folding inwardly.

5. The container carrier of claim 4, wherein said engagement means further comprises:

at least two of said sidewalls having rectangular apertures proximate their proximal ends, said apertures extending into said central base panel whereby when said sidewalls of said container carrier are inwardly folded to a relatively flat position, the head of each of said arm members corresponding to said sidewall having said apertures protrude through said aperture for engagement with the bottom of said central base panel to prevent said sidewalls from returning to an open position.

6. The container carrier of claim 4, further comprising:

holding means near each of said heads for holding said sidewalls and preventing their folding inwardly.

7. The container carrier of claim 1, wherein coining lines separate said sidewalls from said base and permit said sidewalls to be folded into their desired positions.

* * * * *